United States Patent [19]

McCoy

[11] Patent Number: 5,060,623

[45] Date of Patent: Oct. 29, 1991

[54] SPARK DURATION CONTROL FOR A CAPACITOR DISCHARGE IGNITION SYSTEM

[75] Inventor: Steven R. McCoy, Washington, Ill.

[73] Assignee: Caterpillar Inc., Peoria, Ill.

[21] Appl. No.: 630,578

[22] Filed: Dec. 20, 1990

[51] Int. Cl.[5] ..... F02P 5/145; F02P 3/045; F02P 3/08

[52] U.S. Cl. ..... 123/605; 123/609; 123/623; 123/644; 123/643

[58] Field of Search ..... 123/596, 605, 609, 620, 123/623, 634, 643, 644

[56] References Cited

U.S. PATENT DOCUMENTS

| | | | |
|---|---|---|---|
| 3,677,253 | 7/1972 | Oishi et al. | 123/598 |
| 3,714,507 | 1/1973 | Schweitzer et al. | 123/598 |
| 3,832,986 | 9/1974 | Dogadko | 123/598 |
| 3,898,971 | 8/1975 | Lefevre | 123/598 |
| 3,906,919 | 9/1975 | Asik et al. | 123/598 |
| 4,228,778 | 10/1980 | Rabus et al. | 123/605 |
| 4,345,575 | 8/1982 | Jorgensen | 123/598 |
| 4,349,008 | 9/1982 | Wainwright | 123/620 |
| 4,441,479 | 4/1984 | Endo et al. | 123/609 X |
| 4,538,586 | 9/1985 | Miller | 123/620 |
| 4,649,888 | 3/1987 | Kawai et al. | 123/644 X |
| 4,660,534 | 4/1987 | Cotignoli | 123/644 X |
| 4,688,538 | 8/1987 | Ward et al. | 123/598 |
| 4,799,471 | 1/1989 | Lasagna et al. | 123/623 X |
| 4,836,175 | 6/1989 | Hansen et al. | 123/644 X |
| 4,886,036 | 12/1989 | Johansson et al. | 123/620 X |
| 4,899,715 | 2/1990 | Kolwa et al. | 123/644 |
| 4,905,120 | 2/1990 | Grembowicz et al. | 361/154 |

*Primary Examiner*—Willis R. Wolfe
*Attorney, Agent, or Firm*—Kirk A. Vander Leest

[57] ABSTRACT

An apparatus is provided for controlling ignition in an internal combustion engine having N cylinders and a capacitor discharge ignition system. The capacitor discharge system includes an ignition capacitor which is maintained at a predetermined electrical potential by a charging circuit. N transformers are provided, each having a primary coil and a secondary coil. The primary coils include first and second terminals and the secondary coils are electrically connected in parallel with the spark gap in an associated one of the cylinders. Selector switches are connected between the ignition capacitor and an associated one of the primary first terminals. The selector switches are normally biased open and are adapted to close in response to receiving cylinder select signals. The cylinder select signals are produced in response to a desired ignition sequence and for a period of time corresponding to a desired spark duration in an associated cylinder. A modulation switch is connected between the primary coil second terminals and a source of low electrical potential. Control circuitry is provided for operating the modulation switch while a selector switch is closed such that the current flowing in an associated primary coil initially rises to a first threshold sufficient to cause a spark to arc an associated spark gap. Thereafter the current is modulated between the first threshold and a second threshold lower than the first threshold to maintain the spark. The spark is maintained in this manner until the associated selector switch is opened.

12 Claims, 4 Drawing Sheets

DC to DC POWER CONVERTER
CYLINDER SELECTOR MEANS
$V_{REF}$
$V_{REF}$
+ Vc -
12
14
16a
16b
18
22
24
26
28
30
32
34
36
38
40
44
46
48
50
52
53
54
56
58
62
64
66
68
70
72
74
76
78
80
82
84
86
87
88
90
92
97
98
100
102
104
108

DC to DC POWER CONVERTER
CYLINDER SELECTOR MEANS
$V_{REF}$
$V_{REF}$
+ Vc -
12
14
16a
16b
18
22
24
26
28
30
32
34
36
38
40
44
46
48
50
52
53
54
56
58
62
64
66
68
70
72
74
76
78
80
82
84
86
87
88
90
92
97
98
100
102
104
108
110

A)
CYLINDER SELECT SIGNAL
T
TIME
$t_0$
$t_4$
B)
PRIMARY CURRENT
$I_1$
$I_2$
TIME
$t_0$
$t_3$
$t_4$
C)
SPARK GAP VOLTAGE POTENTIAL
V
$V_{SP}$
TIME
$t_0$
$t_1$
D)
COMPARATOR OUTPUT
$V_2$
$V_1$
TIME
$t_3$
E)
COMPARATOR NON-INVERTING INPUT
$V_3$
$V_4$
TIME
$t_3$

SPARK DURATION CONTROL FOR A CAPACITOR DISCHARGE IGNITION SYSTEM

DESCRIPTION

1. Technical Field

This invention relates generally to a capacitor discharge ignition system for an internal combustion engine and, more particularly, to a system for controlling spark duration in a capacitor discharge ignition system.

2. Background Art

Capacitor discharge ignitions (CDI's) are well known in the art. Typically, CDI's include a charge storage mechanism, such as a capacitor, and a step-up transformer with a secondary connected to a spark ignition device, such as a spark plug. A mechanism is provided to discharge the capacitor through the transformer primary coil in timed relationship with a desired engine ignition sequence. The discharge of the capacitor through the transformer primary coil induces a high voltage signal in the transformer secondary coil, which, if sufficiently high, causes a spark to arc across the spark plug gap. More specifically, the voltage applied across a spark ignition device must be greater than or equal to a predetermined characteristic "spark ionization potential" (voltage) in order to initiate the spark. Such ionization potentials are typically on the order of 10 Kv or more. However, once the spark has been initiated, the spark can be sustained by a maintaining a substantially voltage potential across the spark plug gap. Typically this lower voltage potential is on the order of 1 Kv or less.

It is desirable to be able to extend the spark duration to ensure full combustion of the air/fuel mixture in the cylinder. However, past CDI's have suffered from the inability to maintain spark duration for any significant amount of time. This is because CDI's typically use the full capacitor charge to initiate the spark and, therefore, no charge exists for maintaining or extending the spark's duration.

One system which recognize this problem is disclosed in U.S. Pat. No. 3,832,986 which issued on Sept. 3, 1974 to Dogadko. The Dogadko patent discloses a CDI system which includes a main capacitor for establishing the spark and a second capacitor for extending the spark's duration. A fist SCR is triggered to discharge the first capacitor through the ignition primary to establish the spark. A timer means is operative in response to discharge of the main capacitor for triggering a second SCR to discharge the second capacitor through the primary at a predetermined period of time after discharge of the main capacitor, thereby extending the spark. However, the Dogadko system has additional costs associated with the additional capacitors and SCR's. Therefore, it is desirable to provide a CDI which does not require these additional components and has the ability to control spark duration.

The subject invention is directed toward addressing one or more of the problems as set forth above.

DISCLOSURE OF THE INVENTION

An apparatus is provided for controlling ignition in an internal combustion engine having N cylinders and a capacitor discharge ignition system. The capacitor discharge system includes an ignition capacitor which is maintained at a predetermined potential by a charging circuit. A plurality of transformers are provided, each having a primary coil and a secondary coil. Each primary coil includes first and second terminals and each secondary coil is electrically connected in parallel with a spark gap in an associated one of the cylinders. Selector switches are connected between the ignition capacitor and an associated one of the primary first terminals. The selector switches are normally biased open and are adapted to close in response to receiving cylinder select signals. The cylinder select signals being produced in response to a desired ignition sequence and for a period of time corresponding to a desired spark duration in an associated cylinder. A modulation switch is connected between the primary coil second terminals and a source of low electrical potential. Control circuitry is provided for operating the modulation switch while a selector switch is closed such that the current flowing in an associated primary coil initially rises to a first threshold sufficient to cause a spark to arc an associated spark gap. Thereafter the current is modulated between the first threshold and a second threshold lower than the first threshold to maintain the spark. The spark is maintained in this manner until the associated selector switch is opened.

BEST MODE FOR CARRYING OUT THE INVENTION

Figure 1:
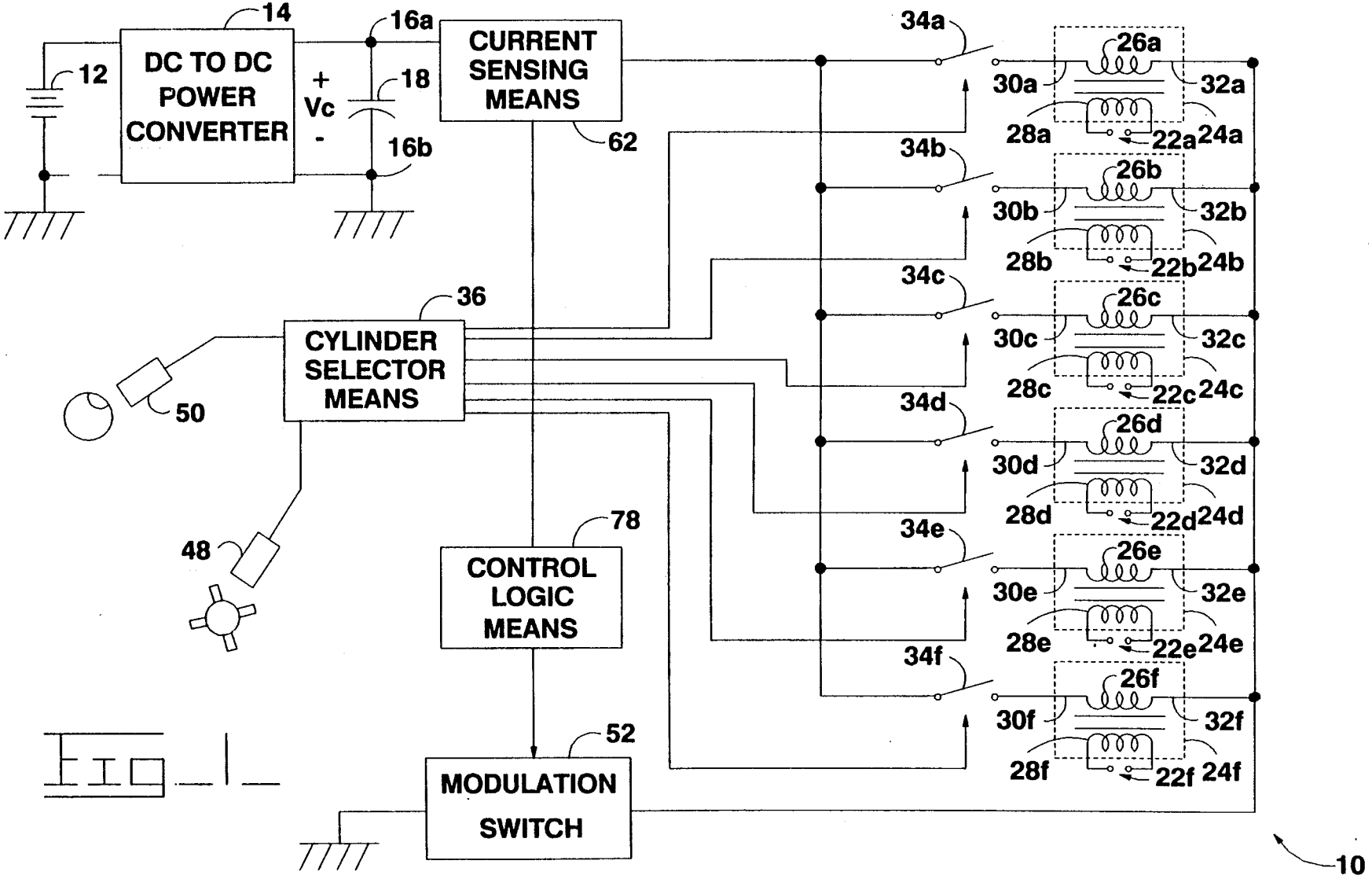
FIG. 1 is an illustrative block diagram of an embodiment of the immediate capacitor discharge ignition system.
Figure 2A:
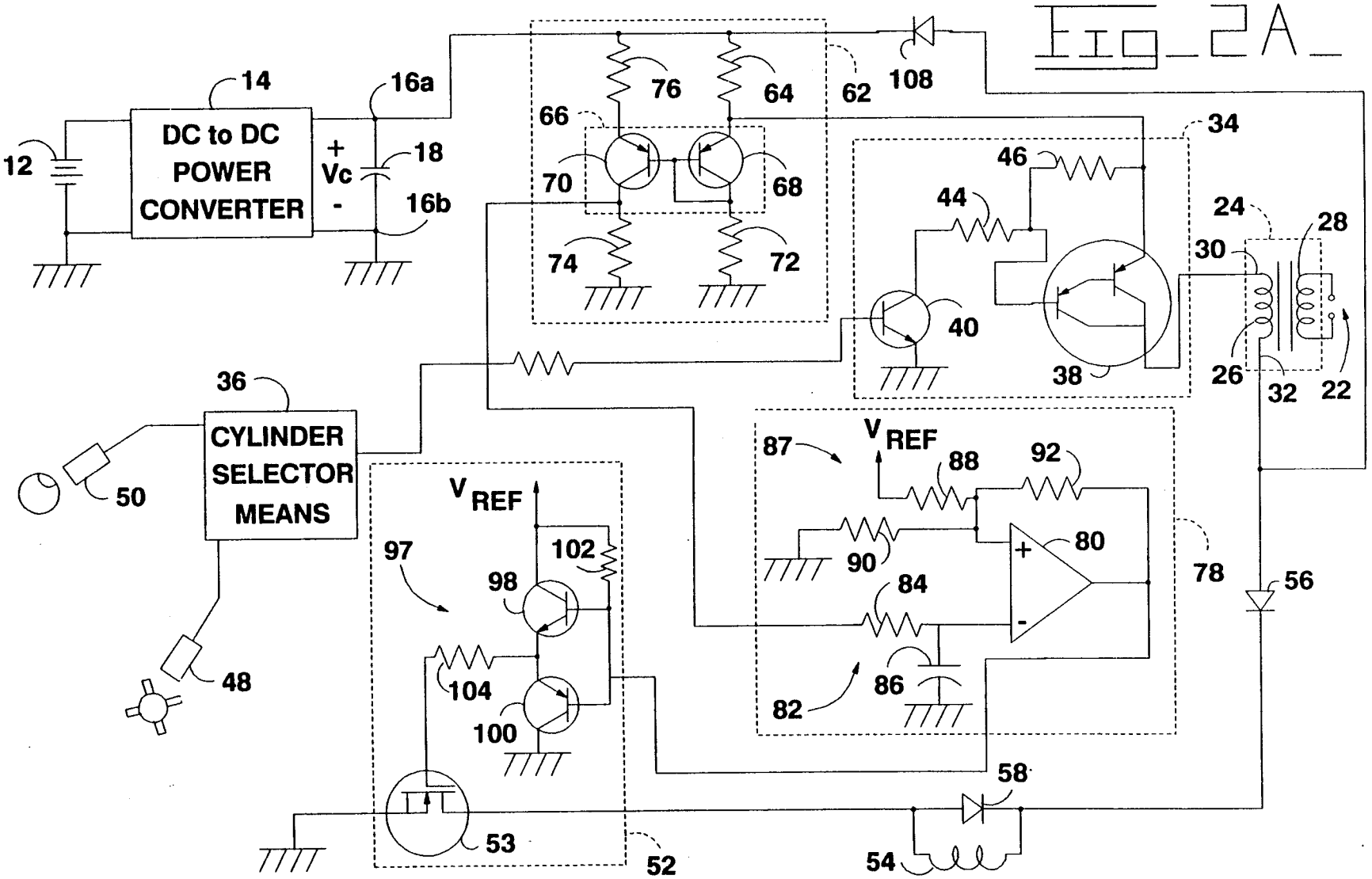
FIG. 2A is circuit diagram of an embodiment of the system of FIG. 1.
Figure 2B:
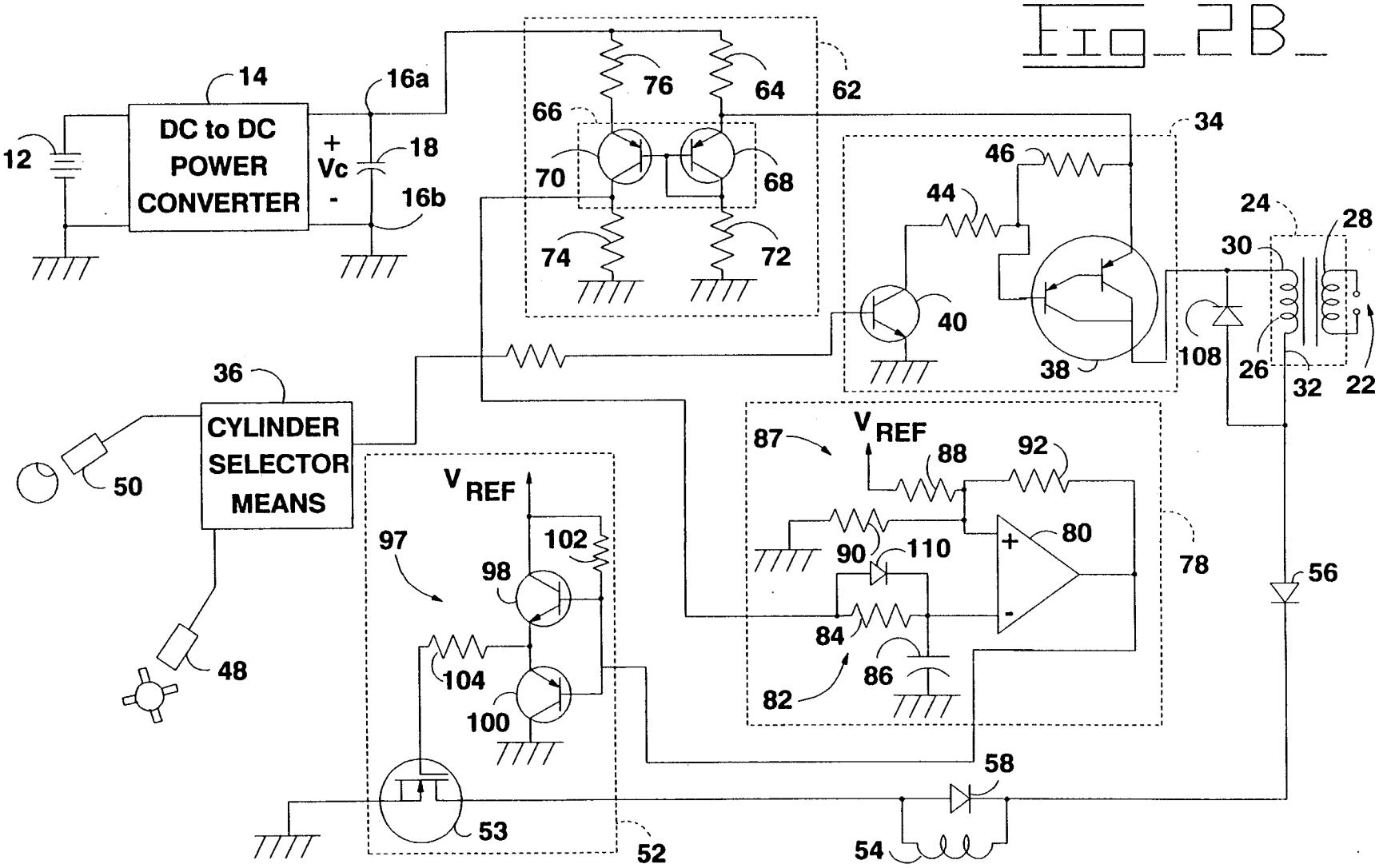
FIG. 2B is a circuit diagram of an alternate embodiment of the system of FIG. 1.

Referring now to the drawings, the immediate capacitor discharge ignition system 10 will be discussed. FIGS. 2A and 2B are circuit diagrams for realizing alternate embodiments of the immediate CDI system 10. The same reference numerals have been used for like components in FIGS. 2A and 2B. For simplification, FIGS. 2A and 2B have been illustrated in connection with a single engine cylinder. However, the system 10 will work with an internal combustion engine having any any number of cylinders provided electrical components are sized properly. Therefore, FIG. 1 is described in connection an engine having six cylinders. Throughout the description of the system 10 reference will be made to certain electrical waveforms illustrated in FIGS. 3A–F.

The system 10 includes a power source 12, such as a battery, connected to a DC-to-DC power converter 14. The power converter 14 is a continuously operating, high speed charging circuit and it is electrically connected to first and second terminals **16*a*, 16*b* of an ignition capacitor 18. The power converter 14 is provided for rapidly charging the ignition capacitor 18 and continuously supplying power to the capacitor 18 to maintain the capacitor first terminal 16*a* at a predetermined electrical potential above the capacitor second terminal 16*b*. More particularly, the capacitor second terminal 16*b* is connected to system ground and the first terminal 16*a*** is maintained a preselected potential $V_c$ above system ground. In the preferred embodiment, the preselected potential $V_c$ is on the order of 200 volts. Converters of this type are common in the art and, therefore, will not be explained in greater detail. One such circuit is generally disclosed in U.S. Pat. No. 3,677,253 which issued on July 18, 1972 to Oishi et al.

Each engine cylinder (not shown) includes a spark plug (not shown) having an associated spark gap 22*a–f*. Step-up transformers 24*a–f* are provided for each cylinder to control operation of an associated spark plug. Each transformers 24*a–f* has a primary coil 26*a–f* and a secondary coil 28*a–f*. The transformer primary coils 26*a–f* each include first and second terminals 30*a–f*, 32*a–f*. The transformer secondary coils 28*a–f* are electrically connected in parallel with a spark gap 22*a–f* in an associated one of the engine cylinders.

Selector switches 34*a–f* are connected between the ignition capacitor first terminal 16*a* and an associated one of the primary coil first terminals 30*a–f*. The selector switches 34*a–f* are normally biased open and are adapted to close in response to receiving a cylinder select signals (See FIG. 3A) from a cylinder selector means 36. Each selector switch includes a darlington-type transistor 38 having an emitter connected to the the ignition capacitor first terminal 16*a* and a collector connected to an associated primary coil first terminals 30*a–f*. It should be apparent that suitable alternatives could be used in place of the electrical components described without departing the scope of the applicant's invention. For example, numerous alternative switches could be used in place of the darlington-type transistor 38. A first npn transistor 40 has a base connected to the cylinder selector means 36. The transistor's base is adapted to receive the selector signal. The first npn transistor 40 further has an emitter connected to system ground and a collector connected to the base of the darlington-type transistor 38 through a first resistor 44. A second resistor 46 is connected between the junction of the first resistor 44 and the darlington-type transistor's base and the junction of the ignition capacitor first terminal 16*a* and the darlington-type transistor's collector. The first npn transistor 40 is biased "on" when the cylinder select signal is applied to its base. This establishes a base current path for the darlington-type transistor 38 which biases the darlington-type transistor 38 "on." When the darlington-type transistor 38 is biased "on", the ignition capacitor first terminal 16*a* and the primary coil first terminal 30*a–f*, of an associated transformer 24*a–f*, are electrically connected, thereby establishing a current path through the primary coil 26*a–f*.

The cylinder selector means 36 is provided for operating the selector switches 34*a–f* in a timed sequence corresponding to a desired ignition sequence for the engine. The cylinder selector means 36 receives signals corresponding to engine speed and cylinder position from engine speed and sensor 48 and a cylinder position sensor 50, respectively. Such sensors are common in the art and, therefore, will not be explained in detail. The function of the sensors 48, 50 could be performed using a single sensor such as that disclosed in U.S. Pat. No. 4,972,323 which issued on Nov. 20, 1990 to Luebbering et al. and is assigned to the assignee herein. The cylinder selector means 36 processes these signals to produce cylinder select signals for controlling operation of the select switches 34*a–f*. The cylinder select means 38 produces the cylinder select signals for a period of time corresponding to the desired spark duration in an associated cylinder. The desired spark duration can be a constant period of time or it can be adjusted in response to sensed engine parameters. The duration that the cylinder select signal remains high corresponds to a desired spark duration T. During this period, the selector switch 34*a–f*, to which the selector signal is delivered, remains closed.

A modulation switch 52 is connected between the primary coil second terminals 32*a–f* and system ground for completing a current path for the primary coils 26*a–f*. When a cylinder select switch 34*a–f* and the modulation switch 52 are closed current begins to flow from the ignition capacitor 18 through the associated primary coil 26*a–f*. The modulation switch 52 includes an n-channel MOSFET 53 having a drain connected to the primary coil second terminals 32*a–f* through an inductor 54 and a first diode 56. The inductor 54 is provided to limit current changes at the MOSFET drain. The MOSFET 53 further has its source connected to system ground. A second diode 58 has a cathode connected to the junction of the inductor 54 and the first diode 56 and an anode connected to the junction of the inductor 54 and the n-channel MOSFET 53. The second diode 58 is provides a flyback path for the inductor 54 to limit voltage spikes caused by the inductor 54 when the n-channel MOSFET 53 opens.

The MOSFET 53 is biased "on" when a "high" logic signal is applied to its gate. When this occurs, the primary coil second terminals 32*a–f* are connected to system ground, thereby establishing a current path for the primary coil 26*a–f* having a "closed" selector switch 34*a–f*.

A current sensing means 62 senses the current flowing through any of the transformer primary coils 26*a–f* and responsively produces a primary current signal. The current sensing means 62 includes a first current sensing resistor 64 connected between the selector switches 34*a–f* and the ignition capacitor first terminal 16*a*. A current mirror circuit 66 is connected to the first current sensing resistor 64 such that the current flowing through the resistor 64 is an input to the current mirror circuit 66. The current mirror circuit 66 delivers an output current signal which has a magnitude responsive to the magnitude of the current flowing through any of the primary coils 26*a–f*. Only one current mirror circuit 66 is required since only one of the cylinder select switches 34*a–f* is closed at any given instance in time.

The current mirror circuit 66 includes first and second pnp transistors 68, 70 wherein both transistors 68, 70 have bases connected to the other and to the collector of the first transistor 68. The collectors of the transistors 68, 70 are further connected to system ground through third and fourth resistors 72, 74, respectively. The emitter of the first pnp transistor 68 is connected to the ignition capacitor first terminal 16*a* through the first current sensing resistor 64. The emitter of the second pnp transistor 70 is connected to the ignition capacitor first terminal 16*a* through a second current sensing resistor 76. As would be apparent to one skilled in the art, selection of the ohmic values of the first and second current resistors 64, 76 controls the relationship between the input and output of the current mirror circuit 66.

Figure 3:
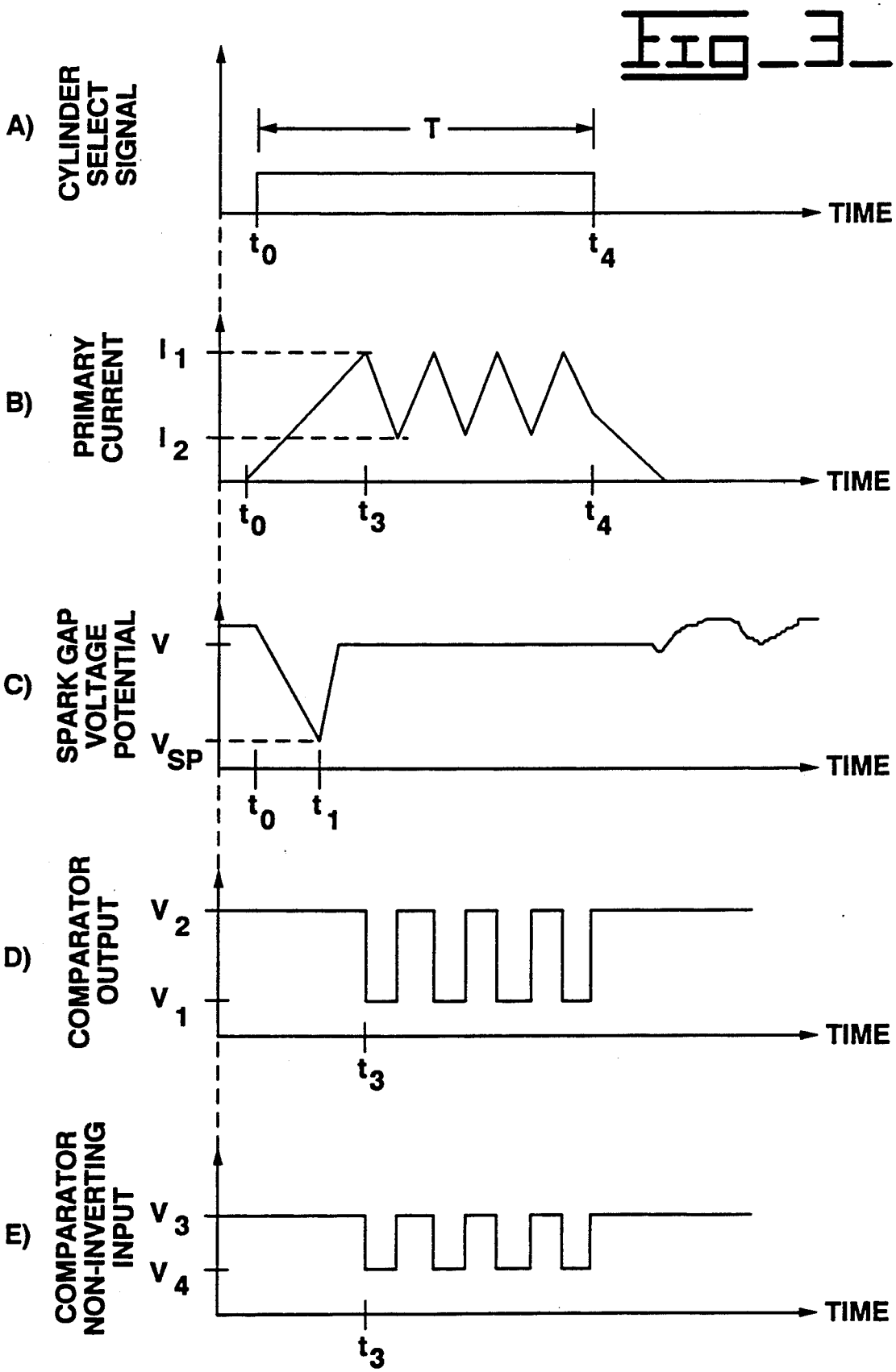
FIGS. 3A–E are graphic illustrations of certain waveforms associated with the embodiments of FIGS. 1, 2A and 2B.

The output of the current mirror is delivered to a control logic means 78 which produces first and second control signals in response to the current mirror output signal. The first and second control signals are applied to the modulation switch 52 to respectively open and close the modulation switch 52. More specifically, the control logic means 78 produces an output signal which switches between first and second voltage potentials V1, V2 (see FIG. 3D). When the signal is at the first potential V1 corresponding to logic "low," the modulation switch 52 is biased open. Conversely, when the signal is at the second potential V2 corresponding to logic "high," the modulation switch 52 is biased closed. The control logic means 78 operates the modulation switch 52 while a selector switch 34*a–f* is closed such that the current flowing in an associated primary coil initially rises to a first current threshold I1 which is sufficient to cause a spark to arc an associated spark gap 22*a–f*. Thereafter, the spark is maintained by modulated the current in the primary coil 26*a–f* between the first current threshold I1 and a second current threshold I2 which is lower than the first current threshold I1. The current flowing through the primary coil 26*a–f* is shown in FIG. 3B and the voltage across and associated spark gap 22*a–f* is shown in FIG. 3C. The second current threshold I2 is selected to be of a magnitude sufficient to ensure that a spark is sustained across the spark gap 22*a–f*. In this manner, the charge dissipated from the ignition capacitor 18 is minimized, thereby avoiding the problems associated with past capacitor discharge ignitions. More specifically, by limiting current flow from the ignition capacitor 18, the immediate CDI system 10 is capable of maintaining spark duration over a wide range of engine speeds while only requiring a single ignition capacitor for a plurality of engine cylinders.

The control logic means 78 includes an open-collector comparator 80 having an inverting input terminal adapted to receive the current mirror output signal. The comparator inverting input terminal is connected to the junction of the second pnp transistor 70 and the fourth resistor 74 through an R-C network 82. The current output from the current mirror circuit 66 establishes a voltage across the fourth resistor 74 which is applied to the comparator inverting input terminal. As should be apparent, this voltage is proportional to the current flowing through the first current sensing resistor 64 and thus to the current in the primary coil 26*a–f*. The R-C network 82 includes a fifth resistor 84 serially connected between the junction of the second transistor's emitter and the fourth resistor 74 and comparator inverting input terminal. The R-C network 82 further includes a first capacitor 86 connected between the junction of the fifth resistor 84 and the comparator inverting input terminal and system ground.

The non-inverting input terminal is connected to a voltage divider network 87 for controlling the voltage level applied thereto. More particularly, the non-inverting input terminal is connected to a preselected reference potential $V_{ref}$ through a pull-up resistor 88 and to system ground through a sixth resistor 90. The non-inverting input terminal is further connected to the output terminal of the comparator 80 through a seventh resistor 92. The output terminal of the comparator 80 switches between logic "low" and logic "high" in response to the primary current signal rising above and falling below the the first and second current thresholds I1, 12, respectively (see FIG. 3D).

When the comparator output terminal is pulled "high," the voltage divider network 87 applies a third voltage potential V3 to the comparator non-inverting input terminal. The voltage potential applied to the comparator non-inverting input terminal is illustrated in FIG. 3E. The third voltage potential V3 corresponds to a primary current having magnitude equal to the first current threshold I1. The comparator output terminal is pulled "low" when the voltage applied to its inverting input terminal rises to the third voltage potential V3, thereby indicating that the primary current has reached the first current threshold I1. When the comparator output terminal is pulled "low," the voltage divider network 87 applies a fourth voltage potential V4, which is lower than the third voltage potential V3, to the comparator non-inverting input terminal. The fourth voltage potential V4 corresponds to a primary current equal to the second current threshold I2. The output from the comparator 80 is delivered to the MOSFET 53 through a transistor network 97.

The transistor network 87 is provided to better control switching of the MOSFET 53. The transistor network 97 includes a second npn transistor 98 and a third pnp transistor 100, both having bases connected to the comparator output terminal and being adapted to receive the comparator output signal. The second npn transistor 98 has a collector connected to the reference voltage $V_{REF}$ and a base connected to the reference voltage $R_{REF}$ through an eighth resistor 102. The third pnp transistor 100 has a collector connected to system ground and an emitter connected to the emitter of the second npn transistor. The base of the MOSFET 53 is connected to the junction of transistors' emitters through a ninth resistor 104 for sensing the voltage at this junction. When the comparator output goes "low," the second npn and third pnp transistors 98, 100 are respectively biased "off" and "on," thereby pulling the base of the MOSFET 53 "low." Conversely, when the comparator output goes "high," the second npn and third pnp transistors 98, 100 are respectively biased "on" and "off," thereby pulling the base of the MOSFET 53 "high."

In a first embodiment (FIG. 2A), the control logic means 78 produces the first and second switching signals in response to the primary current signal rising above and falling below the first and second current thresholds I1, I2, respectively. Whereas, in a second embodiment (FIG. 2B), the control logic means 78 produces the first switching signal in response to the primary current signal rising above the first current threshold I1. In the second embodiment, the second switching signal is produced a predetermined period of time after the production of the first switching signal.

In the first embodiment, a current flyback path is established for the primary coils 26*a–f* which allows the flyback current to flow through first current sensing resistor 64. A flyback diode 108 has an anode connected to the primary coil second terminals 32*a–f*. The cathode of the flyback diode 108 is connected to the junction of the first current sensing resistor 64 and the ignition capacitor first terminal 16*b*. Therefore, when the modulation switch 52 is open and a selector switch 34*a–f* is closed, a flyback current, as established by the charge stored in the associated primary coil 26*a–f*, flows through the first current sensing resistor 64. This current is input to the current mirror circuit 66 and, therefore, the voltage applied to the comparator inverting input terminal is responsive to the primary coil flyback current. When this voltage drops below the fourth voltage potential V4, the comparator output is pulled "high," thereby closing the modulation switch 57.

Conversely, in the second embodiment, individual flyback paths are provided for each primary coils 26*a–f* by connecting flyback diodes 108 between the first and second terminals 30*a–f*, 32*a–f* of each primary coil 26*a–f*. In this embodiment, the flyback current no longer circulates through the first current sensing resistor 64 and, thus, there is no output signal from the current mirror during this flyback period. The second embodiment was developed because CDI systems are often applied to large engines where it might be undesirable to have a flyback path through the first current sensing resistor 64 due to the amount of electrical noise generated in the wiring required to establish such a flyback path.

In the second embodiment, the second switching signal is produced a predetermined period of time after the production of the first switching signal in the second embodiment. This function is provided by the R-C network 87. More particularly, the second embodiment also further includes a third diode 110 having an anode connected to the junction of the second pnp transistor 70 and the fifth resistor 84. The cathode of the third diode 110 is connected to the junction of the comparator inverting input terminal and the fifth resistor 84. When the current mirror circuit 66 produces an output current, the third diode 110 is biased "on" and the current output from the current mirror circuit 66 charges the first capacitor 86. When the primary current reaches the first current threshold I1, the modulation switch 52 opens and no input signal is delivered to the current mirror circuit 66. When this occurs, the voltage applied to the comparator inverting input terminal is controlled by the voltage across the first capacitor 86. This voltage decays at a rate controlled by the R-C network, as would be apparent to those skilled in the art. In the second embodiment, the values of the fifth resistor 84 and the first capacitor 86 are empirically selected so that this voltage decays at the same rate as the the flyback current in the primary coils 26*a–f*. Conversely, in the first embodiment, the R-C network 82 functions solely to filter electrical "noise" from the current mirror output signal. When the voltage reaches a fourth voltage potential V4, the output terminal of the comparator is pulled "high," and the modulation switch 52 responsively closes.

Industrial Applicability

Referring now to FIGS. 3A–E, operation of the CDI system 10 will be explained in greater detail. Initially, the modulation switch 52 is biased closed and all the selector switches 34*a–f* are biased open. At time $t_o$, the cylinder selector means 36 delivers a cylinder select signal (FIG. 3A) to one of the 30 selector switches 34*a–f*, thereby biasing the selector switch 34*a–f* closed. Current starts to flow through the primary coil 26*a–f* in an associated transformer 24*a–f* (FIG. 3B). The current flowing through the primary coil 26*a–f* induces a voltage potential across the spark gap 22*a–f* in an associated spark plug (FIG. 3C). At a time $t_1$, the voltage potential across the spark gap 22*a–f* reaches a potential $V_{SP}$ which is sufficient to cause a spark to arc across the gap 22*a–f*. As mentioned previously, this voltage is on the order of 10–30 kV. When the spark arcs, current begins to flow through the transformer secondary coil 28*a–f*. After the initial spark, the voltage required to sustain a spark across the gap 22*a–f* is substantially reduced. This voltage is indicated by $V_{SUS}$ and is typically on the order of 1 Kv or less.

The current in the primary coil 26*a–f* continues to rise until it reaches the first current threshold I1 at a time $t_3$. When the current reaches the first current threshold I1, the comparator output (FIG. 3D) is pulled "low," thereby opening the modulation switch 52. When the modulation switch 52 is open and a selector switch 34*a–f* is closed, a flyback current circulates through the flyback diode 108. In the first embodiment, the flyback current circulates through the first current sensing resistor 64 and a voltage is applied to the inverting input of the comparator 80 in response to the magnitude of this flyback current.

Conversely, in the second embodiment, the voltage potential applied to the comparator inverting input is controlled by the R-C network 82. When this voltage decays to the fourth voltage potential V4, indicating that the primary current has dropped to the second current threshold I2, the comparator output terminal is pulled "high." This biases the MOSFET 53 "on." The primary current then increases until it reaches the first current threshold I1, at which time the MOSFET 53 is again biased "off." The primary current is modulated in this manner until the selector signal goes "low" at time $t_4$. When this occurs, the selector switch 52 opens, thereby disconnecting the primary coil first terminal 30*a–f* and the ignition capacitor first terminal 16*a*. Thereafter the voltage across the spark gap 22*a–f* drops to a level which is not sufficient to maintain a spark.

In this manner, the charge dissipated from the ignition capacitor 18 is minimized, thereby avoiding the problems associated with past capacitor discharge ignitions. More specifically, by limiting current flow from the ignition capacitor 18, the immediate CDI system 10 is capable of maintaining spark duration over a wide range of engine speeds while only requiring a single ignition capacitor for a plurality of engine cylinders. Other aspect, objects and advantages of this invention can be obtained from a study of the drawings, the disclosure, and the appended claims.

I claim:

1. An apparatus for controlling ignition in an internal combustion engine having N cylinders, a cylinder selector means, and a capacitor discharge ignition system, each of said cylinders including a spark plug having an associated spark gap, said capacitor discharge system being of the type having an ignition capacitor including first and second terminals and charging circuit connected to said ignition capacitor for maintaining said capacitor first terminal at a predetermined electrical potential greater than said capacitor second terminal, said cylinder selector means selectively producing cylinder select signals at desired points in time corresponding to a desired ignition sequence for said engine cylinders, said cylinder select signals being produced for a period of time corresponding to a desired spark duration in an associated cylinder, comprising:

N transformers each having a primary coil and a secondary coil, said primary coils including first and second terminals and said secondary coils being electrically being connected in parallel with a spark gap in an associated one of said N cylinders;

N selector switches each being connected between said ignition capacitor first terminal and an associated one of said primary coil first terminals, said selector switches being normally biased open and being adapted to close in response to receiving said cylinder select signals;

a modulation switch connected between said primary coil second terminals and a source of low electrical potential; and control means for operating said modulation switch while a selector switch is closed such that the current flowing in an associated primary coil initially rises to a first current threshold sufficient to cause a spark to arc an associated spark gap and is thereafter modulated between said first current threshold and a second current threshold lower than said first current threshold to maintain said spark, and wherein said spark is maintained in this manner until said selector switch is opened.

2. An apparatus as set forth in claim 1, wherein said control means includes:

current sensing means for sensing a current flowing through any of said primary coils and responsively producing a primary current signal;

logic means for receiving said primary current signal and producing first and second switching signals in response to said primary current signal rising above and falling below said first and second current thresholds, respectively; and wherein said modulation switch is adapted to receive first and second signals and respectively open and close in response to said first and second signals.

3. An apparatus as set forth in claim 1 wherein said current sensing means includes a current sensing resistor connected between said ignition capacitor first terminal and said primary coil first terminals, and wherein the current flowing through said current sensing resistor is equal to the current flowing through an of said primary coils.

4. An apparatus as set forth in claim 3 including a flyback diode having an anode connected to said primary coil second terminals and a cathode connected to the junction of said ignition capacitor first terminal and said current sensing resistor, and wherein said primary current signal is responsive to an energization current which flows through said current sensing resistor when said modulation switch and one of said N selector switches are closed and to a flyback current flows which through said current sensing resistor when said modulation switch is open and one of said N selector switches are closed.

5. An apparatus as set forth in claim 4, wherein said current sensing means includes a current mirror circuit having the current flowing through said current sensing resistor as an input and being adapted to produce an output signal having a magnitude responsive to the current flowing through said current sensing resistor.

6. An apparatus as set forth in claim 2 wherein said logic means includes a comparator adapted to receive said primary current signal, produce a first switching signal in response to said primary current rising above said first switching threshold and produce said second switching signal in response to said primary current signal falling below said second current threshold.

7. An apparatus as set forth in claim 1, wherein said control means includes:

current sensing means for sensing the current level in any of said transformer primary coils and responsively producing a primary current signal;

logic means for receiving said primary current signal and responsively producing first and second switching signals, said first switching signal being produced in response to said primary current signal rising above a first predetermined thresholds and said second switching signal being produced a predetermined period of time after the production of said first switching signal; and wherein said modulation switch is adapted to receive first and second signals and respectively open and close in response to said first and second signals.

8. An apparatus as set forth in claim 7 including N flyback diodes, each having an anode connected to respective primary coil second terminal and an anode connected to a respective primary coil first terminal.

9. An apparatus as set forth in claim 8 wherein said current sensing means includes a current sensing resistor connected between said ignition capacitor first terminal and said primary coil first terminals.

10. An apparatus as set forth in claim 9, wherein said current sensing means includes a current mirror circuit having the current flowing through said current sensing resistor as an input and being adapted to produce an output signal having a magnitude responsive to the current flowing through said current sensing resistor.

11. An apparatus as set forth in claim 10 wherein said logic means includes:

an R-C network circuit having an input terminal connected to said current mirror output and being adapted to receive said current mirror output signal, an output terminal adapted to produce an output signal current signal, a resistor connected between said R-C network input and output terminals, a capacitor connected between the junction of a said resistor and said R-C network output terminal and a said source of low electrical potential, and a diode having an anode connected to the junction of said resistor and said R-C network input terminal and a cathode connected to the junction of said resistor and said R-C network output terminal; and wherein said primary current signal is responsive to said current mirror output signal when said current mirror circuit produces an output signal and to a decay rate of said R-C network circuit in the absence of an output signal from said current mirror circuit.

12. An apparatus as set forth in claim 11 wherein the decay rate of said R-C network is responsive to a decay rate of of the flyback current through said primary coils.

* * * * *